US007805867B2

(12) United States Patent
Har et al.

(10) Patent No.: US 7,805,867 B2
(45) Date of Patent: Oct. 5, 2010

(54) DEVICE FOR GENERATING STEAM

(75) Inventors: Tang Pong Har, Singapore (SG); Adeline Teo, Singapore (SG); Xiaoming Jia, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 670 days.

(21) Appl. No.: 11/722,473

(22) PCT Filed: Dec. 21, 2005

(86) PCT No.: PCT/IB2005/054355

§ 371 (c)(1),
(2), (4) Date: Jun. 21, 2007

(87) PCT Pub. No.: WO2006/067756

PCT Pub. Date: Jun. 29, 2006

(65) Prior Publication Data

US 2010/0024258 A1 Feb. 4, 2010

(30) Foreign Application Priority Data

Dec. 22, 2004 (EP) ..... 04106869

(51) Int. Cl.
*D06F 75/24* (2006.01)
*D06F 75/08* (2006.01)

(52) U.S. Cl. ..... 38/77.7; 38/77.83

(58) Field of Classification Search ..... 38/74, 38/77.3, 77.6, 77.7, 77.81, 77.83, 77.9, 82; 219/250, 251, 254, 494, 496
See application file for complete search history.

(56) References Cited

U.S. PATENT DOCUMENTS

| | | | | |
|---|---|---|---|---|
| 3,263,350 | A * | 8/1966 | Abraham | 38/77.7 |
| 3,823,497 | A * | 7/1974 | Solomon | 38/77.6 |
| 4,165,455 | A | 8/1979 | Mayfield | |
| 5,042,179 | A * | 8/1991 | van der Meer | 38/77.83 |
| 5,832,639 | A * | 11/1998 | Muncan | 38/77.6 |
| 6,067,403 | A * | 5/2000 | Morgandi | 392/401 |
| 6,430,760 | B2 * | 8/2002 | Johns | 4/598 |
| 6,647,204 | B1 | 11/2003 | Hutchinson | |
| 7,360,328 | B2 * | 4/2008 | Fung | 38/77.6 |
| 2004/0040185 | A1 | 3/2004 | Morgandi et al. | |

FOREIGN PATENT DOCUMENTS

| | | |
|---|---|---|
| CH | 684198 | 7/1994 |
| EP | 390264 | 10/1990 |
| EP | 0595292 A1 | 10/1993 |
| EP | 0843039 A1 | 11/1997 |
| FR | 1089500 | 3/1955 |

* cited by examiner

*Primary Examiner*—Ismael Izaguirre

(57) ABSTRACT

A steam generating apparatus (20) is described, comprising a boiler (24) provided with electric heating means (25) and current controlling means (33, 40; 37) for controlling the current in the heating means; the apparatus further comprising at least one temperature sensor (34) and a pressure sensor (35); the apparatus being capable of generating steam at a variable steam output rate; wherein the controlling means (33, 40; 37) are designed, at a relatively low steam output rate setting, to control the current in the heating means on the basis of a temperature measurement signal (T) from the temperature sensor (34), and wherein the controlling means (33, 40; 37) are designed, at a relatively high steam output rate setting, to control the current in the heating means on the basis of pressure.

13 Claims, 2 Drawing Sheets

DEVICE FOR GENERATING STEAM

FIELD OF THE INVENTION

The present invention relates in general to a device for generating steam. Particularly, the present invention relates to such device where steam is generated in a pressure chamber, at a steam pressure above atmospheric level.

The present invention relates particularly to a domestic appliance such as a steam iron apparatus. Therefore, in the following the invention will be specifically explained for such embodiment. However, it is to be noted that this is to be seen as an example only, not intended to limit the scope of the present invention. For instance, the principles of the present invention are also applicable in the case of a steam cleaner apparatus, or in the case of a steam apparatus for removing wall paper.

BACKGROUND OF THE INVENTION

Prior art steam generating devices comprise a steam vessel receiving water, provided with an electric heating device for heating the water. When current is supplied to the heating device, it generates heat which is transferred to the water, thus creating steam.

The current in the heating device is controlled by a controller for keeping the temperature of the steam at a desired level. To this end, prior art steam generating devices comprise a temperature sensor associated with the heating device or in contact with the steam; if the sensor indicates a temperature above a predetermined level, the heating current is switched off, if the sensor indicates a temperature below a predetermined level, the heating current is switched on.

Some prior art devices also comprise a pressure sensor. EP-0.595.292 discloses a steam generating device provided with a pressure sensor as a safety device: if the pressure becomes too high, the heating current is switched off.

EP-0.843.039 discloses a steam generating device provided with a pump for adding water to the steam vessel. The water is added on the basis of a signal from a pressure sensor.

US-2004/0.040.185-A1 discloses a steam generating device where control is aiming to maintain the steam pressure at a constant level. Instead of using a pressure sensor, as earlier art had done, it proposes to use a temperature sensor and perform control on the basis of the temperature value as detected by the temperature sensor, based on recognition of the existence of a one-to-one relationship between temperature and pressure.

The present invention relates specifically to a steam generating device capable of providing steam at a variable output rate (expressed, for instance, in gram/min). This issue is not addressed by the above-mentioned publications.

EP-0.390.264-B1 discloses a steam generating device with variable steam output rate, wherein the steam output rate is controlled by setting the duty cycle of the heating current, based on the assumption that generating a certain amount of steam requires a certain amount of energy.

SUMMARY OF THE INVENTION

The present invention aims to provide a steam generating device capable of providing steam at a variable output rate with an improved accuracy and safety. Thus, it would be advantageous to have available an electrical signal indicating the steam output rate, which could be utilized by an electronic control device for intelligently controlling the heating element(s), for instance capable of responding adequately to a big dip in steam rate, indicating a sudden steam release caused by an increase in demand, the control device for instance responding by increased steam build-up to anticipate a possible next steam release.

To this end, use is made of the recognition that a one-to-one relationship exists between on the one hand the steam output rate and on the other hand the pressure in the steam vessel, which in turn relates to the temperature in the steam vessel. One possible approach would be to simply perform output rate control on the basis of temperature control, using the output signal of a temperature sensor. However, a problem with temperature sensors, specifically thermistors, is that they exhibit drift, i.e. their properties change over time. As a consequence, it may be that the actual temperature is higher than indicated by the temperature sensor, and consequently the steam pressure may be higher than expected, which may pose a safety problem.

To avoid this problem, an alternative approach would be to use a pressure sensor, capable of providing an electrical output signal indicating the sensed pressure. However, such sensors are quite expensive.

In order to overcome these problems, the present invention proposes a steam generating apparatus which comprises a temperature sensor as well as a pressostat. At relatively low output rates, when the pressure is relatively low and possible variations in pressure do not pose a direct safety problem, control is based on the output signal of the temperature sensor. A possible inaccurate temperature reading may lead to deviations of the steam output rate as compared to the output rate settings, but the pressure does not rise to possibly dangerously high levels. At relatively high output rates, when the pressure is relatively high and possible variations in pressure may pose a safety problem, heating is controlled by the pressostat. Thus, the present invention benefits from the combination of safety at high pressure and intelligent control at lower pressure.

The steam generating apparatus according to the invention is defined in claim 1. Preferred embodiments are described in the claims 2 to 12. The invention further relates to a steam iron system as defined in claim 13.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
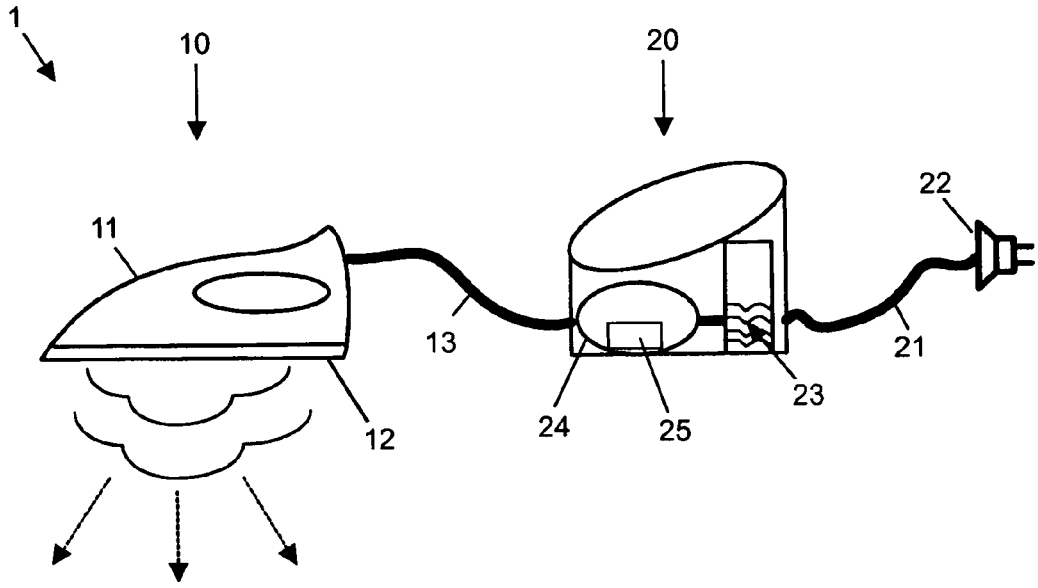
FIG. 1 schematically illustrates a steam iron system.

FIG. 1 schematically illustrates a steam iron system 1, comprising an iron device 10 and a steam generating apparatus 20. As is commonly known, the iron device 10 comprises a housing 11 with a sole plate 12, which is provided with a sole plate heating device not shown for sake of simplicity. A flexible hose 13 connects the iron device 10 to the steam generating apparatus 20, to guide steam from the steam generating apparatus 20 to the inside of the housing 11 of the iron device 10. Steam can exit the housing 11 through holes in the sole plate 12, as schematically indicated by arrows.

FIG. 1 shows that the steam generating apparatus 20 is provided with an electric cable 21 and plug 22 for connection to a standard electric mains, for instance 230 V AC @ 50 Hz. For feeding the sole plate heating device, the iron device 10 also is provided with an electric cable, which typically is incorporated in the flexible hose 13, although it is possible that the iron device 10 is provided with a separate electric cable and plug.

The steam generating apparatus 20 comprises a water reservoir 23 coupled to a steam vessel or boiler 24. The boiler 24 comprises one or more heating elements 25, capable of heating water to produce steam. The iron device 10 may be of a type which is continuously open, i.e. steam generated by the boiler 24 is continuously leaving the boiler 24 through the hose 13 and the iron sole plate 12. It is also possible that the iron device 10 is of a user-controlled steam providing type, i.e. steam is only leaving through the iron sole plate 12 in response to a user action, for instance when a user presses a corresponding steam command button or the like. In any case, when steam is being used ("consumed"), water may be transferred from the water reservoir 23 to the boiler 24 in order to compensate for steam being used, as should be clear to a person skilled in the art. The water reservoir 23 is provided with input means for allowing the water reservoir 23 to be filled with water; such input means are not shown for sake of simplicity.

Figure 2:
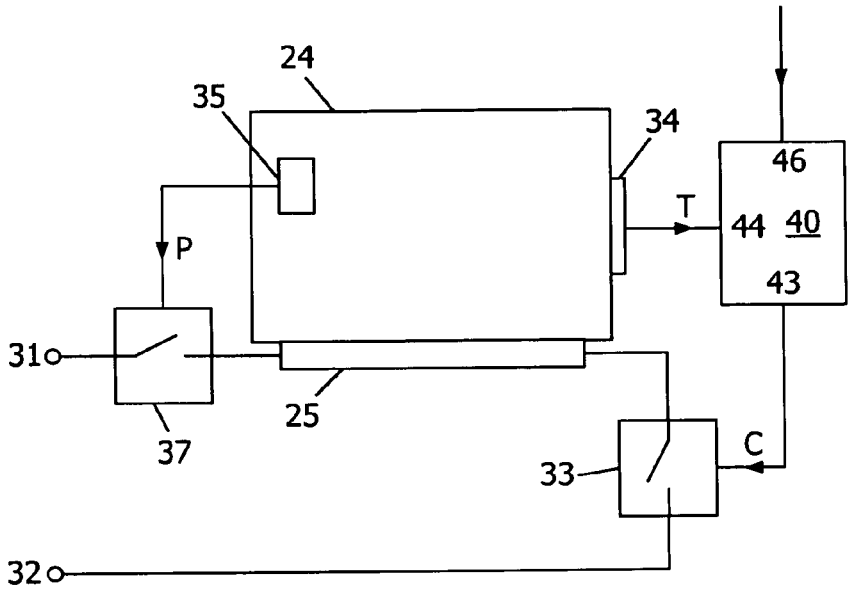
FIG. 2 is a block diagram schematically illustrating a control circuit.

FIG. 2 is a diagram illustrating a relevant part of the electric heating circuit of the steam iron system 1. The heating element 25 (only one heating element is shown in FIG. 2, but the apparatus may comprise more than one heating element) is coupled to terminals 31, 32 for connection with mains (or another source of adequate electrical power). A controllable switch 33 is connected in series with the heating element 25. The controllable switch 33 is controlled by a controller 40.

The steam iron system 1 comprises at least one temperature sensor 34, providing a temperature measurement signal T to a temperature input 44 of the controller 40. FIG. 2 illustrates that the temperature sensor 34 may be located on the boiler wall, at the outside of the boiler. The temperature sensor 34 may also be located inside the boiler 24. The temperature sensor 34 may also be associated with the heating element 25.

The controller 40 further has a user input 46, so that the user can input a steam rate command. It is possible that the user can request for any steam rate within a certain range. For the following discussion it will be assumed that the user can choose from 3 steam rate settings: LOW, MEDIUM and HIGH.

The controller 40 is designed to generate at its control output 43 a control signal C for the controllable switch 33 on the basis of the user selection at input 46 and on the basis of the measurement signal T at input 44. More specifically, the controller 40 internally sets a target level, indicating the temperature corresponding to the steam rate (see the discussion with reference to FIG. 3 below) selected by the user. The controller 40 compares the temperature measurement signal T at input 44 with said internal target level. If the temperature measurement signal T is lower than said internal target level, the controller 40 generates its control signal C such as to close the switch 33 (switch ON; conductive): current flows through the heating element 25, and the temperature rises. If the temperature measurement signal T is higher than said internal target level, the controller 40 generates its control signal C such as to open the switch 33 (switch OFF; non-conductive): the heating element 25 receives no current, and the temperature drops. Thus, the temperature as a function of time fluctuates around the desired temperature.

It is noted that the controller may switch ON and OFF at the same temperature target level, but it is also possible that the controller exhibits some hysteresis, so that the controller turns the first controllable switch 33 to its ON state at or below a second target level lower than a first target level where the first controllable switch 33 is switched OFF.

The steam iron system 1 further comprises a pressure sensor 35, providing a pressure measurement signal P, associated with the boiler 24, typically arranged inside the boiler 24, as shown. A second controllable switch 37, controlled directly by the pressure sensor 35, is connected in series with the first controllable switch 33; particularly, the combination of second controllable switch 37 and pressure sensor 35 is implemented as a pressostat: as long as the pressure in the boiler 24 is below a predetermined pressure threshold level, the second controllable switch 37 is always ON (conductive), while above the predetermined pressure threshold level the second controllable switch 37 is always OFF (non-conductive).

The operation of the apparatus is as follows.

At steam rate settings LOW and MEDIUM, the pressure remains relatively low, so the second controllable switch 37 is always ON, and the current in the heater 25 is determined by the status of the first switch 33 as controlled by the controller, as described above.

At steam rate setting HIGH, the controller 40 always holds the first switch 33 in its ON state (conductive). Temperature and pressure rise, until the pressure in the boiler 24 reaches the predetermined pressure threshold level, at which moment the second controllable switch 37 is switched to its OFF state, interrupting the heater current. This causes the temperature and the pressure to drop, causing the second controllable switch 37 to switch to its ON state, etc. Thus, the temperature as a function of time fluctuates around a temperature corresponding to the pressure setting of the pressostate, which is lower than the internal temperature target level of the controller 40, so the controller 40 continues to try to raise the temperature by keeping the first switch 33 in its ON state (conductive).

It is noted that the pressostat may switch ON and OFF at the same pressure threshold level, but it is also possible that the pressostat exhibits some hysteresis, so that the pressostat turns the second controllable switch 37 to its ON state at or below a second predetermined pressure threshold level lower than a first predetermined pressure threshold level where the second controllable switch 37 is switched OFF.

Figure 3:
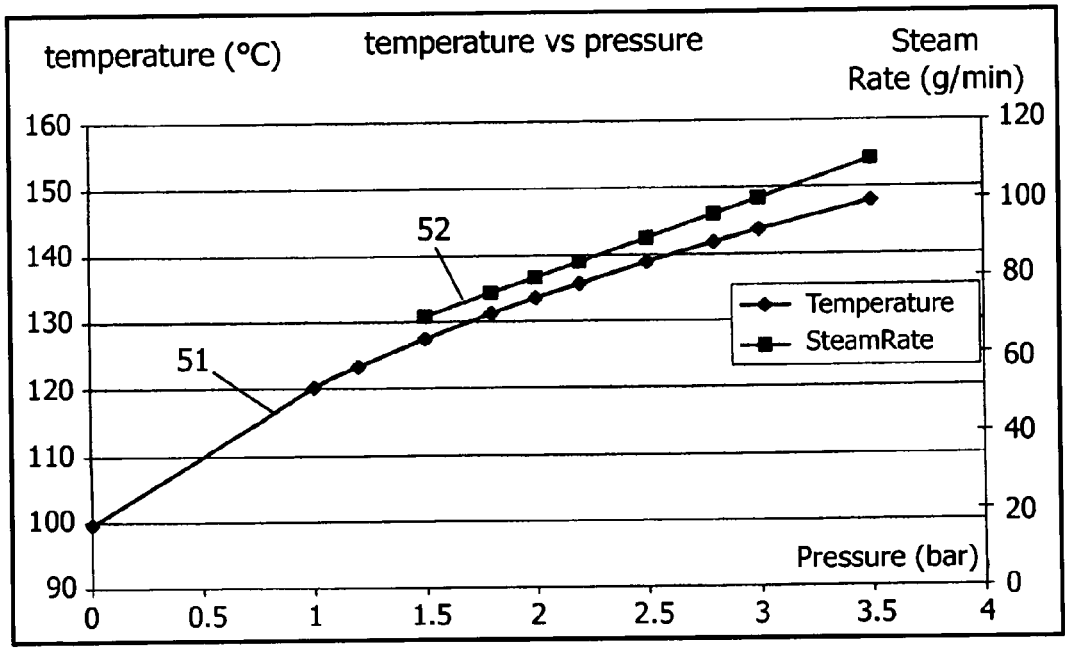
FIG. 3 is a graph illustrating a relationship between temperature, pressure and steam rate.

FIG. 3 is a graph showing experimental results obtained from a specific boiler. The horizontal axis represents pressure in the boiler, expressed in bar above atmospheric pressure (i.e. 1 bar in the graph corresponds to an absolute pressure of 2 bar). The lefthand vertical axis represents temperature of the heating element 25, expressed in degrees Centigrade, as measured by a temperature sensor mounted on the outside of the boiler wall. Curve 51 shows the relationship between temperature and pressure, the diamonds indicating measured results.

The righthand vertical axis represents steam rate, i.e. the amount of steam leaving the boiler through an exit opening, expressed in grams of water per minute.

Curve 52 shows the relationship between steam rate and pressure, the squares indicating measured results. It can clearly be seen that the steam rate depends on pressure, which in turn (curve 51) depends on temperature.

It is to be noted that the precise temperature as measured may depend on the location chosen for mounting the temperature sensor, so this temperature may deviate somewhat from the actual steam temperature, which is the relevant temperature. Nevertheless, there will always be a one-to-one relationship between measured temperature and actual steam temperature, so there can always be found a relationship like the one illustrated in FIG. 3. Depending on apparatus design, including the temperature sensor location, it may be necessary to perform a calibration operation, as will be clear to a person skilled in the art.

EXAMPLE

If the user has set the steam rate at LOW (70 g/min), the controller 40 operates the switch OPEN and CLOSED such that the temperature input signal T reads approximately 128°.

If the user has set the steam rate at MEDIUM (90 g/min), the controller 40 operates the switch OPEN and CLOSED such that the temperature input signal T reads approximately 138°.

If the user has set the steam rate at HIGH (110 g/min), the controller 40 operates the switch OPEN and CLOSED such that the pressure input signal P reads approximately 3.5 bar.

It should be clear to a person skilled in the art that the present invention is not limited to the exemplary embodiments discussed above, but that several variations and modifications are possible within the protective scope of the invention as defined in the appending claims.

For instance, as in the embodiment of FIG. 2, the apparatus may comprise two switches in series, both being controlled by a controller.

Further, it is possible to use a pressostat with variable setting, capable of being changed by a user.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A steam generating apparatus, comprising a boiler provided with electric heating means and current controlling means for controlling an electrical current in the heating means, the apparatus being capable of generating steam at a variable steam output rater, wherein the current controlling means comprises:

at least one temperature sensor;

a first controllable switch arranged in series, electrically, with the electric heating means, the first controllable switch being controlled on the basis of a temperature of the steam in the boiler; and a pressostat comprising a pressure sensor arranged for sensing the pressure in the boiler and a second controllable switch arranged in series, electrically, with the electric heating means, the second controllable switch being controlled by said pressure sensor.

2. The steam generating apparatus as claimed in claim 1, wherein the current controlling means when a steam output rate is below a predefined threshold setting, controls the second controllable switch to be constantly ON (conductive) and controls the first controllable switch on the basis of a temperature measurement signal from the temperature sensor such that steam temperature is controlled to be substantially equal to a predetermined temperature corresponding to a desired steam output rate; and wherein the current controlling means, when the steam output rate is above said predefined threshold setting, controls the first controllable switch to be constantly ON (conductive) and controls the second controllable switch on the basis of a pressure measurement signal from the pressure sensor such that steam pressure is controlled to be substantially equal to a predetermined pressure corresponding to the desired steam output rate.

3. The steam generating apparatus as claimed in claim 1, wherein the temperature sensor senses the temperature of the steam in the boiler.

4. The steam generating apparatus as claimed in claim 1, wherein the temperature sensor senses a temperature of the heating means.

5. The steam generating apparatus as claimed in claim 1, wherein the temperature sensor senses a temperature of the wall of the boiler.

6. The steam generating apparatus as claimed in claim 1, wherein the first controllable switch is controlled by the temperature sensor directly.

7. The steam generating apparatus as claimed in claim 1, wherein the pressostat is switches the second controllable switch OFF when the pressure in the boiler is equal to or larger than a first predetermined pressure threshold level, and switches the second controllable switch ON when the pressure in the boiler is equal to or lower than a second predetermined pressure threshold level, the second predetermined pressure threshold level being equal to or lower than the first predetermined pressure threshold level.

8. The steam generating apparatus as claimed in claim 1, wherein the current controlling means comprise a controller having an input coupled to receive a temperature measurement signal from the temperature sensor, a user input for receiving a user input defining the steam rate setting, and a control output coupled to control the first controllable switch.

9. The steam generating apparatus as claimed in claim 8, wherein the controller, in response to receiving a user input signal indicating a steam output rate setting, controls the first controllable switch such that steam temperature is controlled to be substantially equal to a temperature corresponding to the desired steam output rate.

10. The steam generating apparatus as claimed in claim 8, wherein the controller, in response to receiving a user input signal indicating a steam output rate setting, determines a target temperature level corresponding to the desired steam output rate, compares a temperature measurement signal from the temperature sensor with the target temperature level, and generates a control signal for the first controllable switch such that the first controllable switch is switched OFF when the temperature measurement signal indicates a temperature equal to or higher than said target temperature level, and the first controllable switch is switched ON when the temperature measurement signal indicates a temperature equal to or lower than said target temperature level.

11. The steam generating apparatus as claimed in claim 10, wherein the controller exhibits hysteresis.

12. The steam generating apparatus as claimed in claim 8, wherein the controller, in response to receiving a user input signal indicating a HIGH steam output rate setting, generates a control signal for the first controllable switch such that the first controllable switch is always switched ON.

13. A steam iron system comprising an ironing device and a steam generating apparatus as claimed in claim 1, said steam iron system further comprising a steam transfer hose for transferring steam from the steam generating apparatus to the ironing device.

* * * * *